US007373758B2

(12) United States Patent
Tsai et al.

(10) Patent No.: US 7,373,758 B2
(45) Date of Patent: May 20, 2008

(54) SEISMIC BRACE WITH A REMOVABLE RESTRAINING MEMBER DISPOSED AROUND A MIDDLE PORTION OF AN ELONGATED CENTRAL BRACE UNIT

(75) Inventors: Keh-Chyuan Tsai, Taipei (TW); Sheng-Lin Lin, Taipei Hsien (TW)

(73) Assignee: National Applied Research Laboratories, Taipei (TW)

( * ) Notice: Subject to any disclaimer, the term of this patent is extended or adjusted under 35 U.S.C. 154(b) by 0 days.

(21) Appl. No.: 11/717,901

(22) Filed: Mar. 13, 2007

(65) Prior Publication Data

US 2007/0240368 A1 Oct. 18, 2007

Related U.S. Application Data

(62) Division of application No. 10/739,926, filed on Dec. 17, 2003, now abandoned.

(30) Foreign Application Priority Data

Dec. 18, 2002 (TW) ..... 91220540 U

(51) Int. Cl.
*E04B 1/98* (2006.01)
*E04H 9/02* (2006.01)

(52) U.S. Cl. ..... 52/167.3; 52/167.1; 52/638; 52/724.5; 52/741.1

(58) Field of Classification Search ..... 52/167.1, 52/167.3, 638, 642, 693, 695, 723.1, 724.1, 52/724, 741.1, 741.15, 223.1, 223.4; 405/229; 188/371, 378

See application file for complete search history.

(56) References Cited

U.S. PATENT DOCUMENTS

| | | | | |
|---|---|---|---|---|
| 5,471,810 | A * | 12/1995 | Sugisawa et al. | 52/731.7 |
| 7,185,462 | B1 * | 3/2007 | Smelser | 52/167.3 |
| 7,188,452 | B2 * | 3/2007 | Sridhara | 52/167.3 |
| 7,231,743 | B2 * | 6/2007 | Takeuchi et al. | 52/167.3 |
| 7,305,799 | B2 * | 12/2007 | Smelser et al. | 52/167.3 |

FOREIGN PATENT DOCUMENTS

| | | | |
|---|---|---|---|
| JP | 11159010 | A * | 6/1999 |
| JP | 2000220211 | A * | 8/2000 |
| JP | 2000265706 | A * | 9/2000 |
| JP | 2001059270 | A * | 3/2001 |
| JP | 2001140340 | A * | 5/2001 |
| JP | 2002138583 | A * | 5/2002 |
| JP | 2002147052 | A * | 5/2002 |
| JP | 2002167863 | A * | 6/2002 |
| JP | 2002276035 | A * | 9/2002 |
| JP | 2002357013 | A * | 12/2002 |

* cited by examiner

*Primary Examiner*—Winnie Yip
(74) *Attorney, Agent, or Firm*—Ladas & Parry LLP

(57) ABSTRACT

A seismic brace includes an elongated central brace unit and a rigid restraining member. The central brace unit has two ends adapted to be connected fixedly to a framework of a building, and a middle portion interconnecting the ends and having a cross-sectional area that is smaller than those of the ends. The restraining member is disposed around the middle portion of the central brace unit in a tight fit manner so as to prevent buckling of the central brace unit when the building is subjected to an earthquake, and includes two halves that are interconnected removably.

2 Claims, 16 Drawing Sheets

SEISMIC BRACE WITH A REMOVABLE RESTRAINING MEMBER DISPOSED AROUND A MIDDLE PORTION OF AN ELONGATED CENTRAL BRACE UNIT

CROSS-REFERENCE TO RELATED APPLICATION

This patent application is a divisional application of U.S. Ser. No. 10/739,926, filed on Dec. 17, 2003 now abandoned and claims priority of Taiwanese Application No. 091220540 filed on Dec. 18, 2002.

BACKGROUND OF THE INVENTION

1. Field of the Invention

This invention relates to a seismic brace that has two ends connected fixedly to a framework of a building, and more particularly to a seismic brace that includes an elongated central brace unit and a restraining member which is disposed around the central brace unit in a tight fit manner to prevent buckling of the central brace unit when the building is subjected to an earthquake.

2. Description of the Related Art

Referring to FIGS. 1, 2, and 3, a first conventional seismic brace 70 is shown to have an elongated diagonal central brace unit 130 connected fixedly to a framework of a building at two ends thereof, and a rigid restraining member 120 that includes a rectangular steel tube 122 sleeved around a middle portion of the central brace unit 130 in a tight fit manner to prevent buckling of the central brace unit 130 when the building is subjected to an earthquake, and a concrete material 110 that fills a space between the central brace unit 130 and the steel tube 122. The central brace unit 130 has a cross-shaped cross-section, is welded to cross-shaped-cross-sectioned plates (not shown) on the framework of the building at two ends of the central brace unit 130, and includes a main plate 132 having a middle portion and two ends that are wider than the middle portion, and two wing plates 131, 133 welded respectively to two opposite side surfaces of the main plate 132. An unbounding layer 140 is disposed between the concrete material 110 and the central brace unit 130 so as to permit relative longitudinal sliding movement of the central brace unit 130 and the restraining member 120. For example, the unbounding layer 140 is a grease layer.

Although the central brace unit 130 is able to absorb effectively the energy of earthquakes, to delay the damage of the framework of the building resulting from the shock of earthquakes, and to break prior to breakage of the parts of the framework coupled to the central brace unit 130, the first conventional seismic brace 70 has a disadvantage in that the restraining member 120 cannot be removed from the central brace unit 130 after each earthquake to permit inspection of the central brace unit 130.

Referring to FIGS. 4, 5, 6, and 7, a second conventional seismic brace 72 is shown to include an elongated diagonal central brace unit connected fixedly to a framework of a building at two ends thereof, and a restraining member 160. The central brace unit includes two spaced-apart T-shaped-cross-sectioned plate assemblies 150, each of which consists of a main plate 151 and a wing plate 152 that are welded to and that are perpendicular to the main plate 151. The restraining member 160 includes two adjacent rectangular steel tubes 162 sleeved respectively around the plate assemblies 150 and interconnected fixedly by connecting steel plates 170, and a concrete material 110 that fills spaces between the plate assemblies 150 and the steel tubes 162. Each of the plate assemblies 150 is spaced apart from the concrete material 110 by an unbounding layer 140. As such, two spaces 73 (see FIG. 5) are formed between the plate assemblies 150 at two ends of the second conventional seismic brace 72 so as to permit insertion of two connecting plates (not shown), which are fixed on the framework of the building, thereby attaching the second conventional seismic brace 72 fixedly to the framework. Likewise, the restraining member 160 cannot be removed from the plate assemblies 150.

SUMMARY OF THE INVENTION

The object of this invention is to provide a seismic brace that includes a restraining member which can be removed from an elongated central brace unit to permit checking of the central brace unit.

According to this invention, a seismic brace includes an elongated central brace unit and a rigid restraining member. The central brace unit has two ends connected fixedly to a framework of a building, and a middle portion interconnecting the ends and having a cross-sectional area that is smaller than that of each of the ends. The restraining member is disposed around the middle portion of the central brace unit in a tight fit manner so as to prevent buckling of the central brace unit when the building is subjected to an earthquake, and includes two halves that are interconnected removably.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
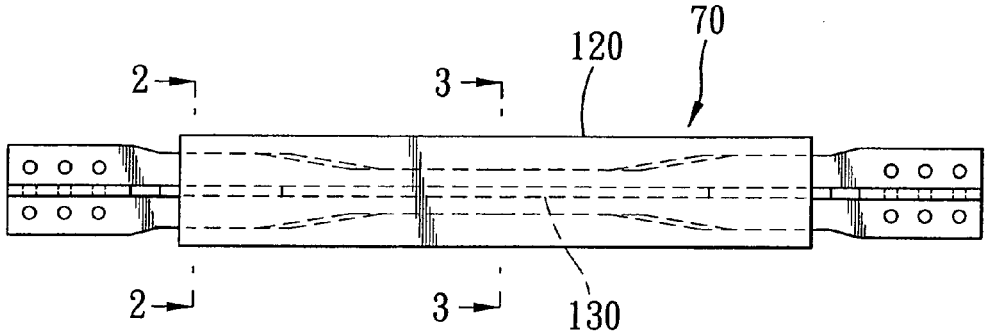
FIG. 1 PRIOR ART
FIG. 1 is a side view of a first conventional seismic brace.
Figure 2:
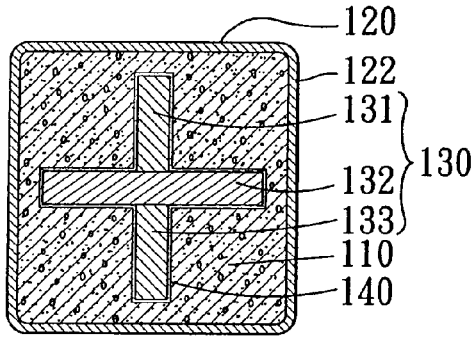
FIG. 2 PRIOR ART
FIG. 2 is a sectional view of the first conventional seismic brace taken along Line 2-2 in FIG. 1.
Figure 3:
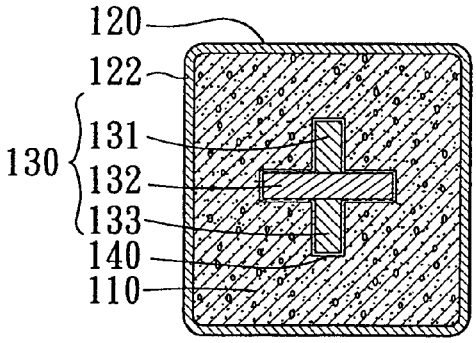
FIG. 3 PRIOR ART
FIG. 3 is a sectional view of the first conventional seismic brace taken along Line 3-3 in FIG. 1.
Figure 4:
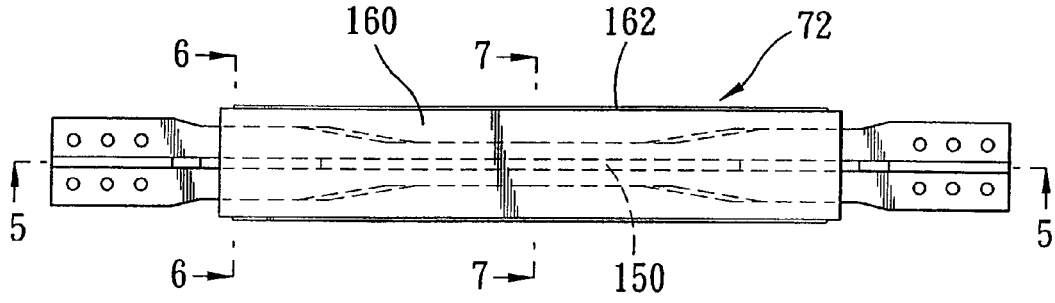
FIG. 4 PRIOR ART
FIG. 4 is a side view of a second conventional seismic brace.
Figure 5:
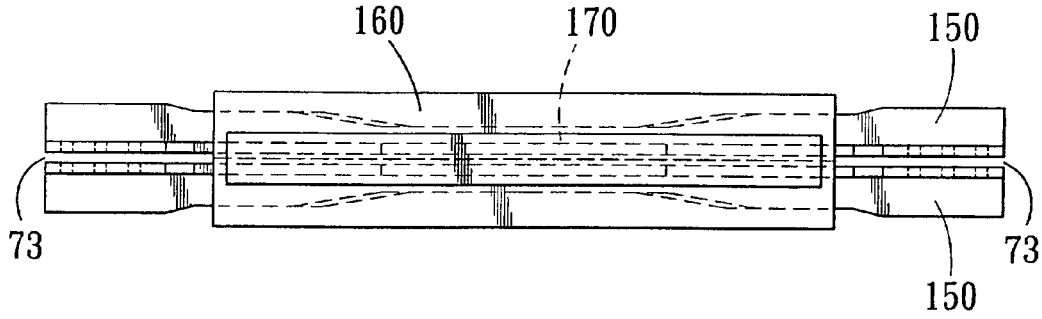
FIG. 5 PRIOR ART
FIG. 5 is a sectional view of the second conventional seismic brace taken along Line 5-5 in FIG. 4.
Figure 6:
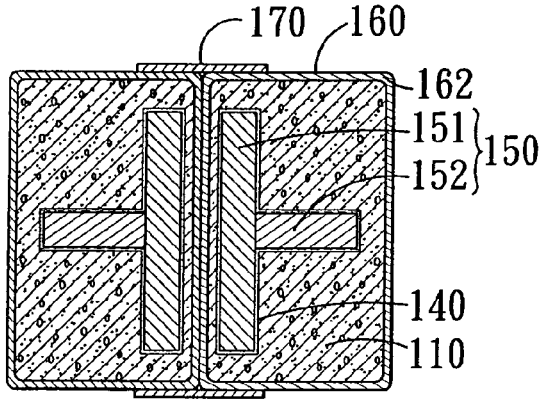
FIG. 6 PRIOR ART
FIG. 6 is a sectional view of the second conventional seismic brace taken along Line 6-6 in FIG. 4.
Figure 7:
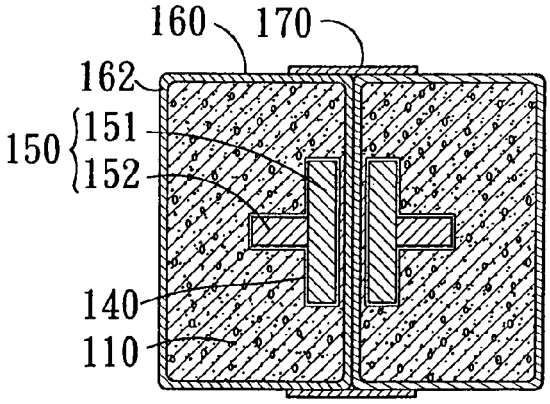
FIG. 7 PRIOR ART
FIG. 7 is a sectional view of the second conventional seismic brace taken along Line 7-7 in FIG. 4.

Before the present invention is described in greater detail in connection with the preferred embodiments, it should be noted that similar elements and structures are designated by like reference numerals throughout the entire disclosure.

Referring to FIGS. 8, 9, 10, and 11, the first preferred embodiment of a seismic brace according to this invention is shown to include an elongated central brace unit 180 having a middle portion 180' and two ends 180", and a rigid restraining member 190 sleeved around the middle portion 180' of the central brace unit 180.

The ends 180" of the central brace unit 180 project outwardly of the restraining member 190. The central brace unit 180 consists of an elongated main plate 181 and four coplanar end plates 182, as shown in FIG. 8A. The main plate 181 has a uniform-width middle portion 181' and two ends 181" that are wider than the middle portion 181'. At each end 181" of the main plate 181, two of the end plates 182 are welded respectively to two opposite side surfaces of the main plate 181 such that the central brace unit 180 has a cross-shaped cross-section at two ends of the restraining member 190 to define four tube-receiving spaces 182' (see FIG. 10) in the restraining member 190, as shown in FIG. 8A. As such, the middle portion 180' of the central brace unit 180 has a cross-sectional area that is smaller than that of each end 180" of the central brace unit 180. A plurality of holes 185 are formed through the end plates 182 and the two ends 181" of the main plate 180 so as to permit extension of lock bolts (not shown) therethrough, thereby facilitating interconnection between the central brace unit 180 and cross-shaped-cross-sectioned plates (not shown) on a framework of a building, which are to be welded to the ends 180" of the central brace unit 180.

The restraining member 190 has two halves 190' (see FIG. 10), each of which includes two parallel rectangular steel tubes 191 disposed respectively within the corresponding two tube-receiving spaces 182' in the restraining member 190 and flanking and abutting against the corresponding end plate 182 at each end 180" of the central brace unit 180, and a connecting plate 195 welded to the steel tubes 191 so as to interconnect the steel tubes 191 fixedly. Each of the halves 190' of the restraining member 190 is formed with two projection units at two opposite sides thereof. Each of the projection units includes a row of projections 192, each of which is shaped as an L-shaped angle steel that has a first plate portion 192' (see FIG. 11) welded to the corresponding steel tube 191 of the corresponding half 190', and a second plate portion 192" (see FIG. 11) extending integrally and perpendicularly from a side of the first plate portion 192' and formed with a hole 196 therethrough. A plurality of lock bolts 194 extend respectively through the holes 196 in the projections 192 of each of the halves 190' of the restraining member 190 so as to interconnect the halves 190' of the restraining member 190 removably. Each of the lock bolts 194 also extends through a shim 193 that is disposed between the corresponding two second plate portions 192" of the projections 192. As such, each of the main plate 181 and the end plates 182 is disposed between and abuts against an adjacent pair of the steel tubes 191. That is, the restraining member 190 is disposed around the middle portion 180' of the central brace unit 180 in a tight fit manner so as to prevent buckling of the central brace unit 180 when the building is subjected to an earthquake. After an earthquake, the halves 190' of the restraining member 190 can be removed from each other and from the central brace unit 180 to permit checking of the conditions of the central brace unit 180. If the central brace unit 180 is intact, the restraining member 190 can be mounted back to the central brace unit 180 so as to permit continuous use of the seismic brace.

To increase the stiffness of the central brace unit 180, the middle portion 180' of the central brace unit 180 can also have a cross-shaped cross-section in a manner similar to that of the ends 180" of the central brace unit 180. Each of the steel tubes 191 can be filled with a concrete material so as to further prevent buckling of the-central brace unit 180.

FIGS. 12, 13, 14, and 15 show the second preferred embodiment of a seismic brace according to this invention, which is similar to the first preferred embodiment in construction except that, in each of the halves 200', two parallel rectangular steel tubes 191 are interconnected fixedly by a plurality of U-shaped metal plates 202 that confine the steel tubes 191 therein and that are sized to prevent movement of the steel tubes 191 between the central brace unit 180 and the U-shaped metal plates 202 in a transverse direction of the seismic brace.

FIGS. 16, 17, 18, and 19 show the third preferred embodiment of a seismic brace according to this invention, which is similar to the first preferred embodiment in construction. Unlike the first preferred embodiment, each of the halves 210' of the restraining member 210 includes a channel steel 211 that is formed with two projection units at two opposite sides thereof. Each of the projection units includes a row of rectangular lugs 213 which are formed integrally with the corresponding channel steel 211 and which is formed with two holes 214, through each of which a lock bolt 212 extends. A hexagonal-cross-sectioned slot 215 is defined between the channel steels 211, and receives the central brace unit 180 therein. A space between the central brace unit 180 and the channel steels 211 is filled with a concrete material 110 so as to prevent movement of the central brace unit 180 between the channel steels 211 in the transverse direction of the seismic brace. After an earthquake, the channel steels 211 can be removed from each other and from the concrete material 110, after which the concrete material 110 can be crushed to separate from the central brace unit 180 to permit checking of the conditions of the central brace unit 180.

Figure 22:
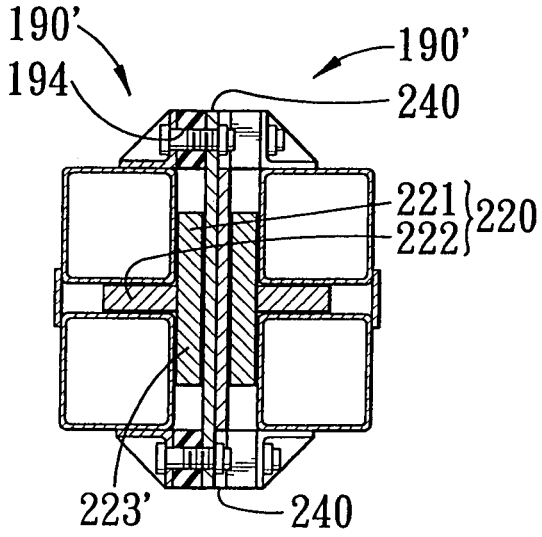
FIG. 22 is a sectional view of the fourth preferred embodiment taken along Line 22-22 in FIG. 20.
Figure 23:
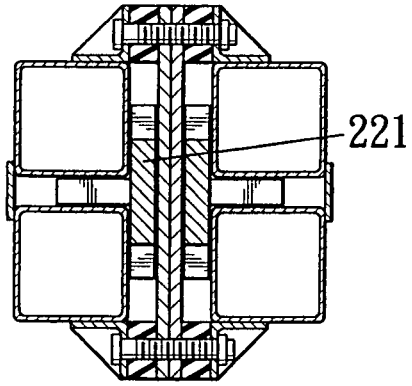
FIG. 23 is a sectional view of the fourth preferred embodiment taken along Line 23-23 in FIG. 20.
Figure 24:
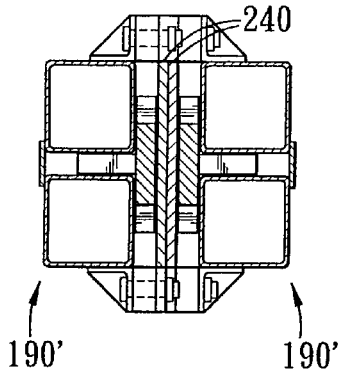
FIG. 24 is a sectional view of the fourth preferred embodiment taken along Line 24-24 in FIG. 20.
Figure 25:
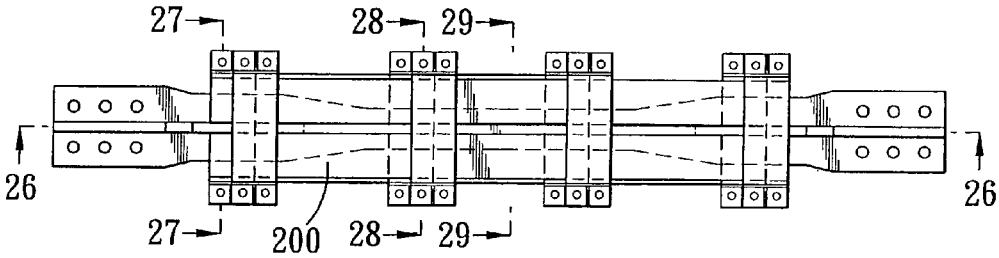
FIG. 25 is a side view of the fifth preferred embodiment of a seismic brace according to this invention.
Figure 26:
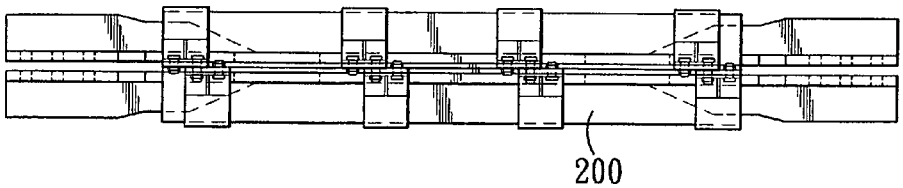
FIG. 26 is a sectional view of the fifth preferred embodiment taken along Line 26-26 in FIG. 25.
Figure 27:
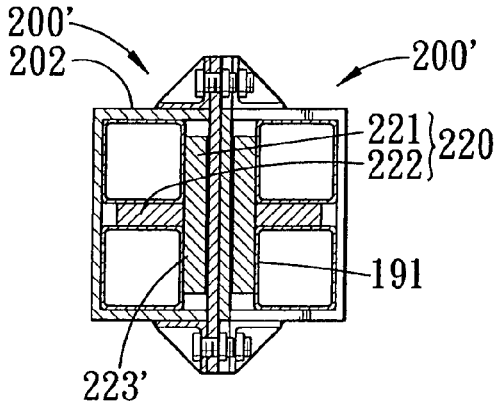
FIG. 27 is a sectional view of the fifth preferred embodiment taken along Line 27-27 in FIG. 25.
Figure 28:
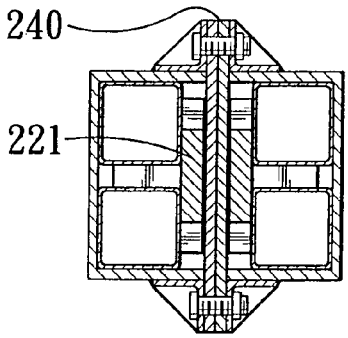
FIG. 28 is a sectional view of the fifth preferred embodiment taken along Line 28-28 in FIG. 25.
Figure 29:
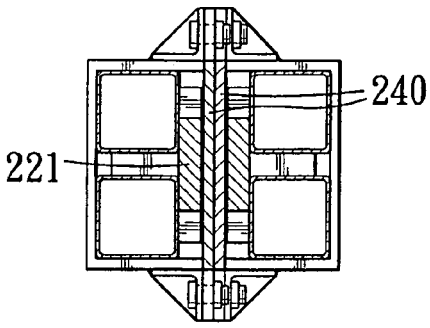
FIG. 29 is a sectional view of the fifth preferred embodiment taken along Line 29-29 in FIG. 25.
Figure 30:
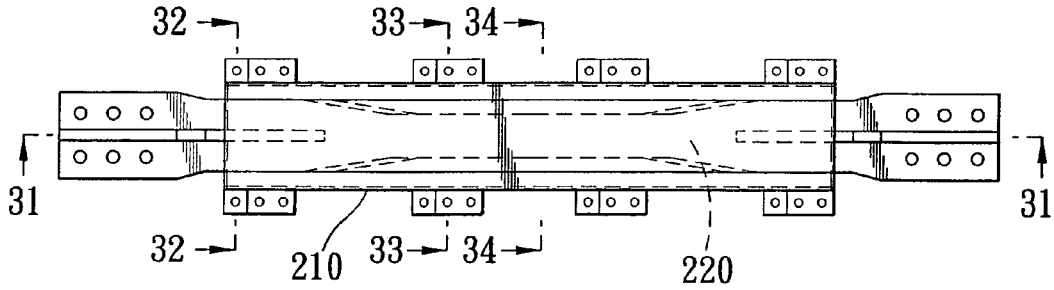
FIG. 30 is a side view of the sixth preferred embodiment of a seismic brace according to this invention.
Figure 31:
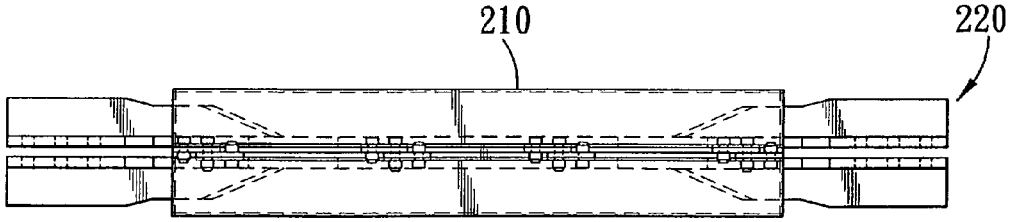
FIG. 31 is a sectional view of the sixth preferred embodiment taken along Line 31-31 in FIG. 30.
Figure 32:
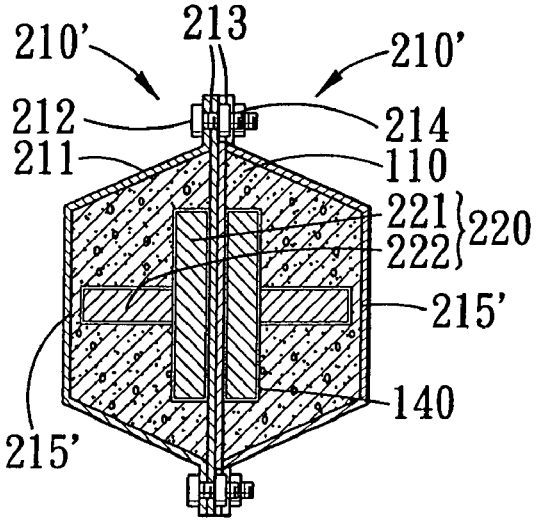
FIG. 32 is a sectional view of the sixth preferred embodiment taken along Line 32-32 in FIG. 30.
Figure 33:
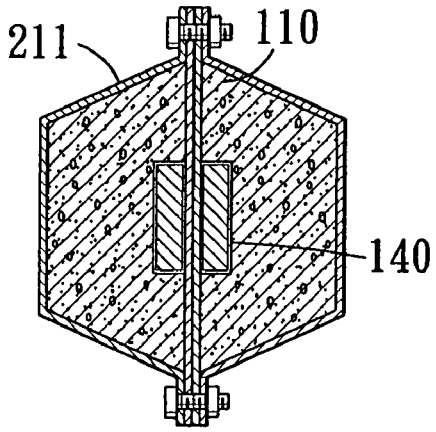
FIG. 33 is a sectional view of the sixth preferred embodiment taken along Line 33-33 in FIG. 30.
Figure 34:
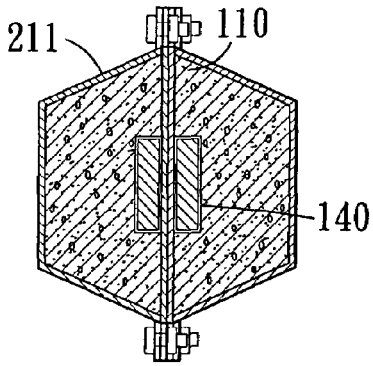
FIG. 34 is a sectional view of the sixth preferred embodiment taken along Line 34-34 in FIG. 30.

FIGS. 20, 21, 22, 23, and 24 show the fourth preferred embodiment of a seismic brace according to this invention, which includes an elongated brace unit 220 and a rigid restraining member 190. The central brace unit 220 includes two elongated parallel main plates 221 each having a uniform-width middle portion 221' and two ends 221" that are wider than the middle portion 221', and four coplanar end plates 222 that are welded respectively to the ends 221" of the main plates 221. Two parallel spacer plates 240 are disposed between and are parallel to the main plates 221, and abut against each other such that an assembly of the central brace unit 220 and the spacer plates 240 has a cross-shaped cross-section at two ends of the restraining member 190 to define four tube-receiving spaces in the restraining member 190, as shown in FIG. 22.

The restraining member 190 has two halves 190' (see FIG. 22), each of which is similar to the first preferred embodiment shown in FIGS. 8, 9, 10, and 11 in construction. The halves 190' of the restraining member 190 are interconnected removably by a plurality of lock bolts 194. As such, the central brace unit 220 is divided into two spaced-apart plate assemblies 223 (see FIG. 21) by the spacer plates 240. Because the end plates 222 are welded to the ends 221" of the main plates 221, as described above, each of the plate assemblies 223 has two T-shaped ends 223', as shown in FIG. 22. The portions of the plate assemblies 223 projecting outwardly of the restraining member 190 are spaced apart from each other to define a space 223" therebetween. Two connecting plates (not shown) on the framework of the building are inserted respectively into and are fixed respectively within the spaces 223" in the central brace unit 220 for connection with the central brace unit 220.

FIGS. 25, 26, 27, 28, and 29 show the fifth preferred embodiment of a seismic brace according to this invention, which is similar to the fourth preferred embodiment in construction except that, in each of the halves 200' of the restraining member 200, two parallel rectangular steel tubes 191 are interconnected fixedly by a plurality of U-shaped metal plates 202 that confine the steel tubes 191 therein and that are sized to prevent movement of the steel tubes 191 between the central brace unit 220 and the U-shaped metal plates 202 in the transverse direction of the seismic brace.

FIGS. 30, 31, 32, 33, and 34 show the sixth preferred embodiment of a seismic brace according to this invention, which is similar to the first preferred embodiment in construction. Unlike the fourth preferred embodiment, each of the halves 210' of the restraining member 210 includes a channel steel 21 that has two projection units at two opposite sides thereof. Each of the projection units includes a row of rectangular lugs 213 which are formed integrally with the corresponding channel steel 211 and which has two holes 214, through each of which a lock bolt 212 extends. A hexagonal-cross-sectioned slot is defined between the channel steels 211, receives the central brace unit 220 therein, and is divided by the spacer plates 240 into two space halves 215' of a trapezoid cross-section, each of which receives a respective one of the plate assemblies 223 therein. A space between the channel steels 211 and an assembly of the central brace unit 220 and the spacer plates 240 is filled with the concrete material 110 so as to prevent movement of the central brace unit 220 between the channel steels 211 in the transverse direction of the seismic brace.

Figure 8:
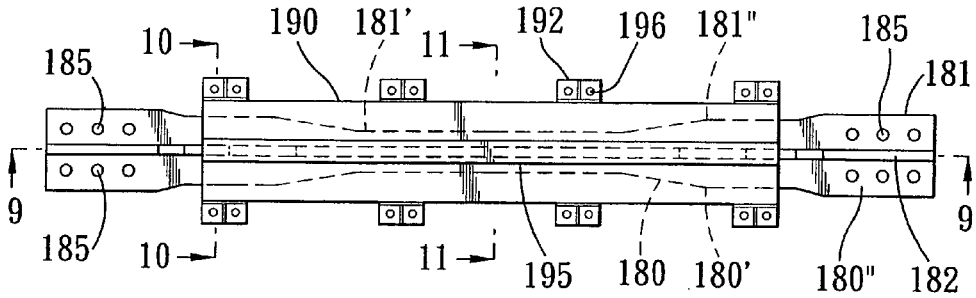
FIG. 8 is a side view of the first preferred embodiment of a seismic brace according to this invention.
Figure 8A:
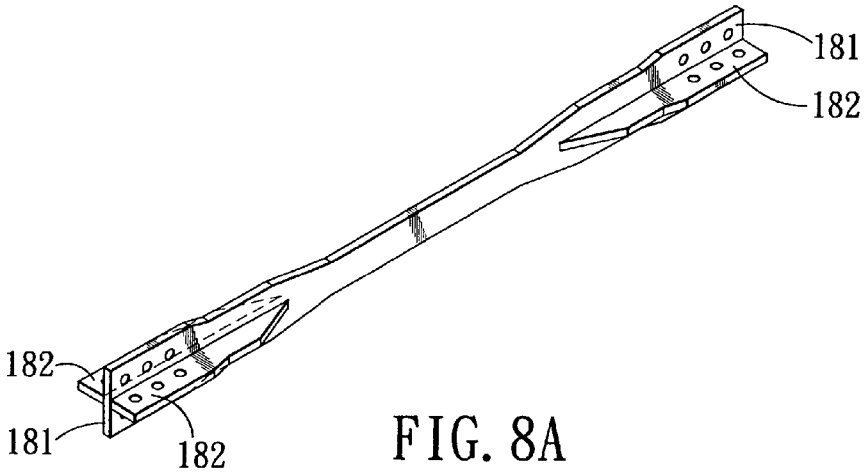
FIG. 8A is a perspective view of a central brace unit of the first preferred embodiment.
Figure 9:
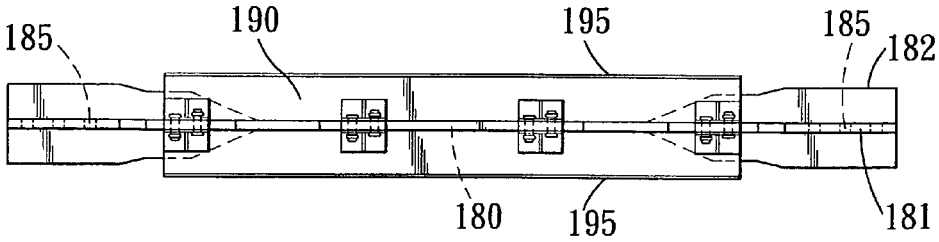
FIG. 9 is a sectional view of the first preferred embodiment taken along Line 9-9 in FIG. 8.
Figure 10:
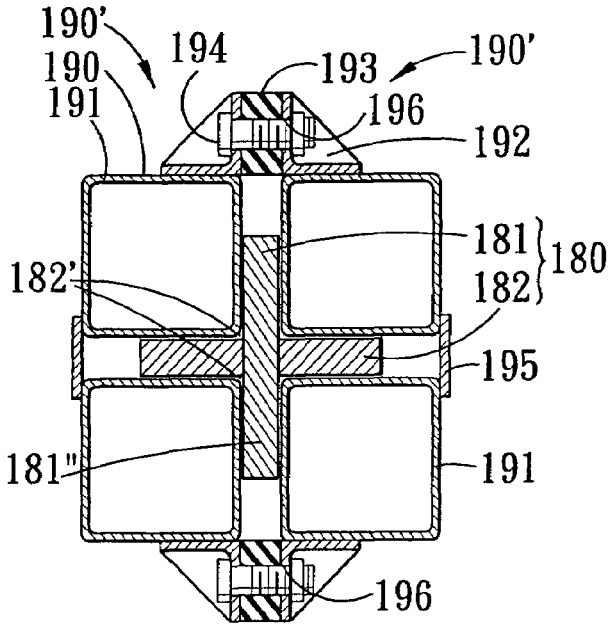
FIG. 10 is a sectional view of the first preferred embodiment taken along Line 10-10 in FIG. 8.
Figure 11:
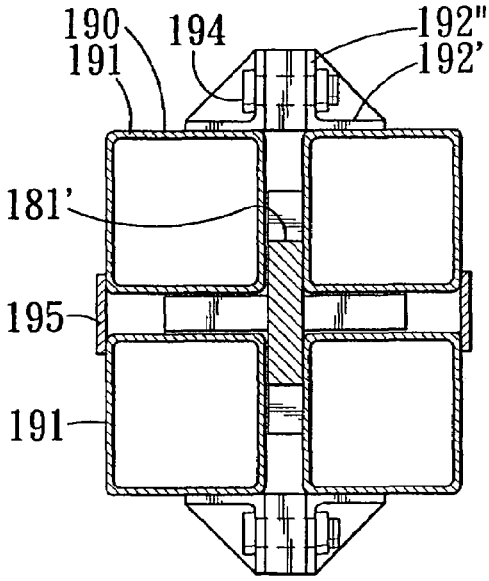
FIG. 11 is a sectional view of the first preferred embodiment taken along Line 11-11 in FIG. 8.
Figure 12:
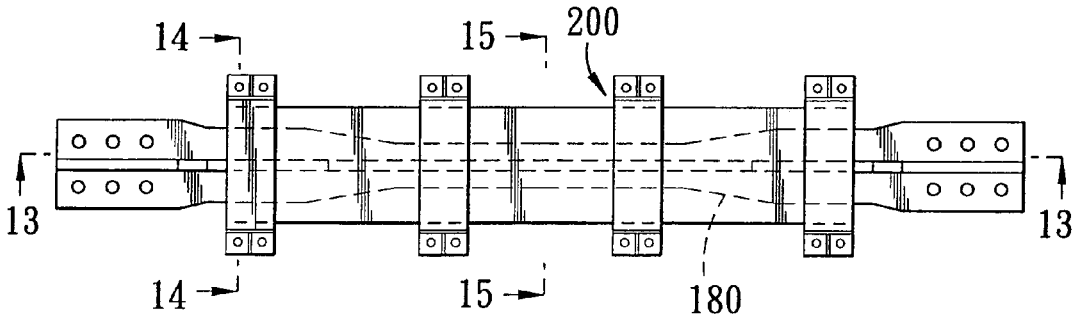
FIG. 12 is a side view of the second preferred embodiment of a seismic brace according to this invention.
Figure 13:
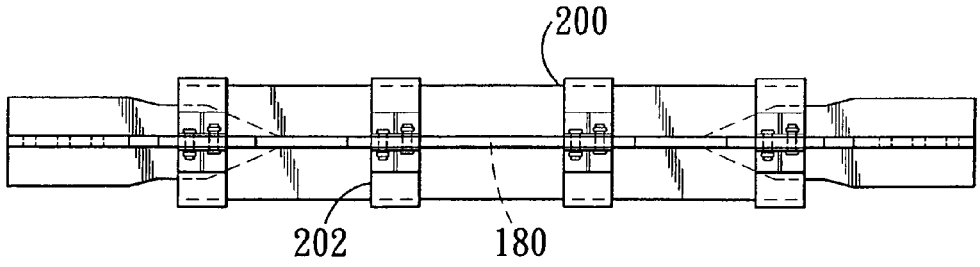
FIG. 13 is a sectional view of the second preferred embodiment taken along Line 13-13 in FIG. 12.
Figure 14:
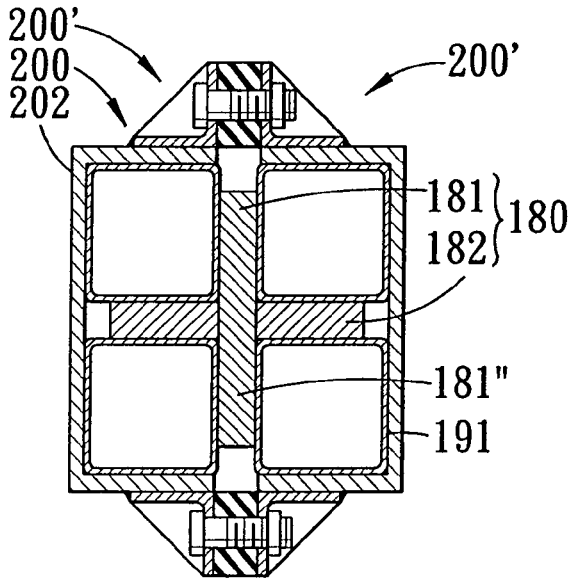
FIG. 14 is a sectional view of the second preferred embodiment taken along Line 14-14 in FIG. 12.
Figure 15:
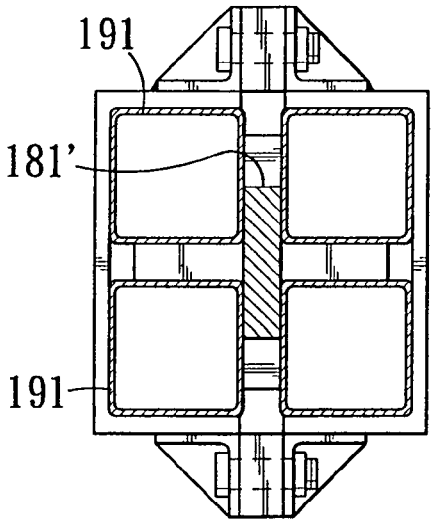
FIG. 15 is a sectional view of the second preferred embodiment taken along Line 15-15 in FIG. 12.
Figure 16:
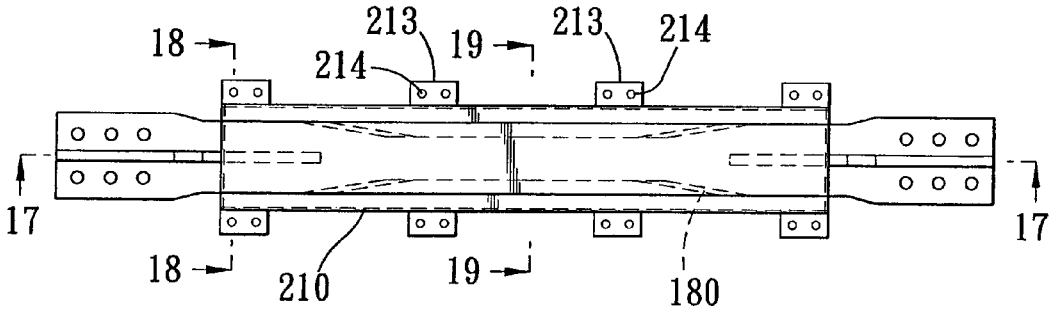
FIG. 16 is a side view of the third preferred embodiment of a seismic brace according to this invention.
Figure 17:
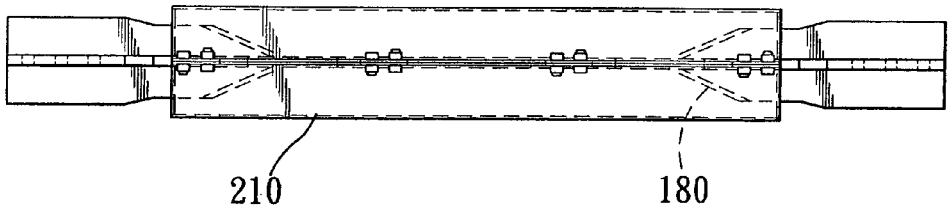
FIG. 17 is a sectional view of the third preferred embodiment taken along Line 17-17 in FIG. 16.
Figure 18:
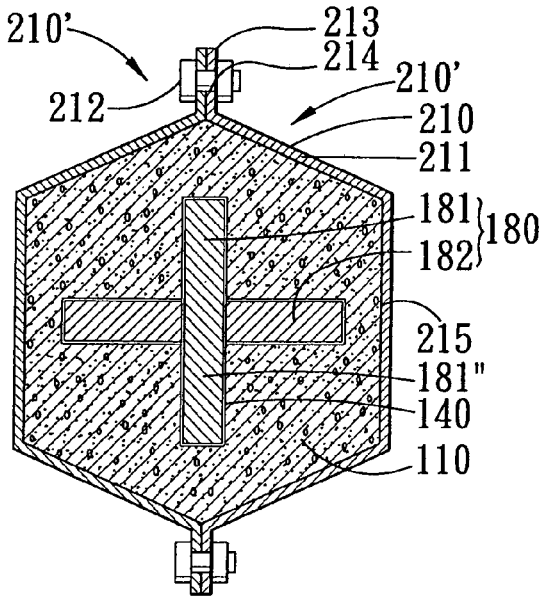
FIG. 18 is a sectional view of the third preferred embodiment taken along Line 18-18 in FIG. 16.
Figure 19:
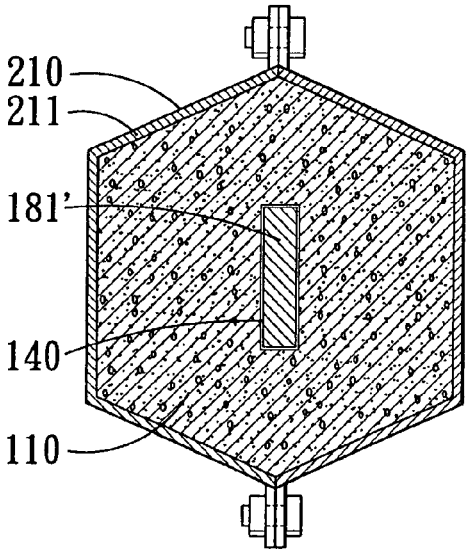
FIG. 19 is a sectional view of the third preferred embodiment taken along Line 19-19 in FIG. 16.
Figure 20:
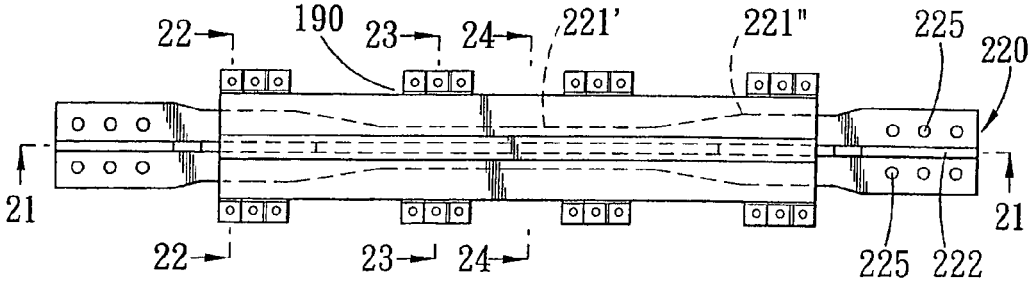
FIG. 20 is a side view of the fourth preferred embodiment of a seismic brace according to this invention.
Figure 21:
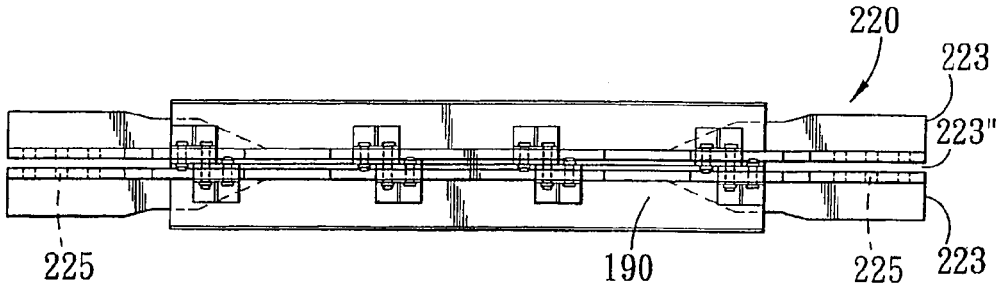
FIG. 21 is a sectional view of the fourth preferred embodiment taken along Line 21-21 in FIG. 20.
Figure 35:
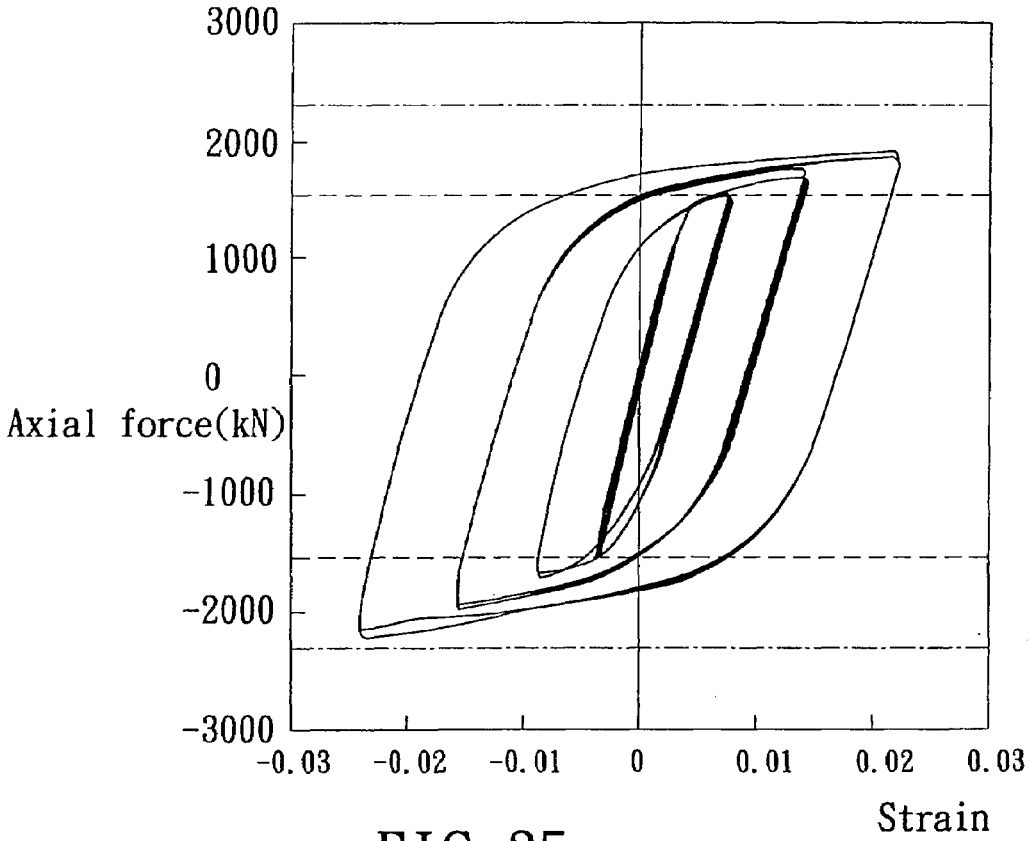
FIG. 35 is a diagram illustrating the relationship between an axial force exerted on a central brace unit of this invention and the strain of the central brace unit.

FIG. 35 is a diagram illustrating the relationship between an axial force exerted on the elongated central brace unit 180, 220 (see FIGS. 8. 20) of this invention and the strain of the central brace unit 180, 220 (see FIGS. 8, 20). It can be seen that the seismic brace of this invention has a relatively good energy absorption capacity.

With this invention thus explained, it is apparent that numerous modifications and variations can be made without departing the scope and spirit of this invention. It is therefore intended that this invention be limited only as indicated by the appended claims.

We claim:

1. A seismic brace comprising:

an elongated central brace unit having two ends adapted to be connected fixedly to a framework of a building, and a middle portion interconnecting said ends and having a cross-sectional area that is smaller than that of each of said ends; and a restraining member disposed around said middle portion of said central brace unit in a tight fit manner so as to prevent buckling of said central brace unit when the building is subjected to an earthquake, said restraining member including two halves that are interconnected removably, wherein said central brace unit includes two elongated parallel main plates each having a middle portion and two ends that are wider than said middle portion, and four coplanar end plates welded respectively to said ends of said main plates, said brace further including two parallel spacer plates that are disposed between and that are parallel to said main plates and that abut against each other and said main plates such that an assembly of said central brace unit and said spacer plates has a cross-shaped cross-section at two ends of said restraining member to define four tube-receiving spaces in said restraining member; and each of said halves of said restraining member includes two parallel rectangular steel tubes disposed respectively within corresponding two of said tube-receiving spaces in said restraining member and flanking and abutting against corresponding two of said end plates, and a connecting plate welded to said steel tubes so as to interconnect said steel tubes fixedly.

2. A method of providing a restraining member in a building having a framework and subject to earthquakes, the method comprising:

(a) installing in said building an elongated member having distal ends by connecting said distal ends to the framework of the building, the elongated member having a central portion to which are removably attached restraining members, the restraining members stiffening the elongated member so as to inhibit buckling thereof when the building in which to elongated member is installed is subject to an earthquake wherein said elongated member includes two elongated parallel main plates each having a middle portion and two ends that are wider than said middle portion, and four coplanar end plates welded respectively to said ends of said main plates, said restraining members further including two parallel spacer plates that are disposed between and that are parallel to said main plates and that abut against each other and said main plates such that an assembly of said elongated member and said spacer plates has a cross-shaped cross-section at two ends of said restraining members to define four tube-receiving spaces in said restraining members; and each of said restraining members includes two parallel rectangular steel tubes disposed respectively within corresponding two of said tube-receiving spaces in said restraining member and flanking and abutting against corresponding two of said end plates, and a connecting plate welded to said steel tubes so as to interconnect said steel tubes fixedly;

(b) after the building has been subjected to an earthquake, removing the restraining members from said elongated member to permit inspection of the elongated member, and inspecting the elongated member; and (c) if the elongated member passes inspection after the earthquake, replacing the restraining members by reattaching them to the elongated member.

* * * * *